US007682168B2

(12) United States Patent
Hsiao

(10) Patent No.: US 7,682,168 B2
(45) Date of Patent: Mar. 23, 2010

(54) SHIELDED MEMORY CARD CONNECTOR

(75) Inventor: Hsueh-Lung Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,734

(22) Filed: Dec. 27, 2007

(65) Prior Publication Data

US 2008/0160829 A1 Jul. 3, 2008

(30) Foreign Application Priority Data

Dec. 27, 2006 (TW) ..... 95222919 U

(51) Int. Cl.
*H01R 13/62* (2006.01)

(52) U.S. Cl. ..... 439/159; 439/630; 439/607.14

(58) Field of Classification Search ..... 439/159, 439/630, 946, 607.01, 607.14
See application file for complete search history.

(56) References Cited

U.S. PATENT DOCUMENTS 6,206,710 B1 3/2001 Chen
6,648,694 B2 11/2003 Takamori et al.
D541,752 S * 5/2007 Van Haaster ..... D13/153
2006/0172572 A1* 8/2006 Matsukawa et al. ..... 439/159
2007/0155244 A1* 7/2007 Lai et al. ..... 439/630
2008/0009161 A1* 1/2008 Sun et al. ..... 439/141

* cited by examiner

*Primary Examiner*—Edwin A. Leon
*Assistant Examiner*—Vanessa Girardi
(74) *Attorney, Agent, or Firm*—Andrew C. Cheng; Wei Te Chung; Ming Chieh Chang

(57) ABSTRACT

An electrical card connector (100) adapted for receiving an electrical card comprises an insulative housing (1), a plurality of terminals (3) received in the insulative housing, and a shell (2) assembled on the insulative housing. The insulative housing comprises a front wall (12) and a pair of lateral walls (18) extending from the opposite ends of the front wall. The insulative housing defines a card inserting opening (101) opposite to the front wall along a card inserting direction. The shell comprises a main portion (21) and a pair of lateral portions (22) extending downwardly from the opposite sides of the main portion, each lateral portion only defines a soldering plate (226) extending inwardly therefrom at the distal end thereof adjacent to the card inserting opening.

19 Claims, 4 Drawing Sheets

SHIELDED MEMORY CARD CONNECTOR

BACKGROUND OF THE INVENTION

1. Field of the Invention

The present invention generally relates to an electrical card connector, and more specially to an electrical card connector mounted on a Printed Circuit Board (PCB).

2. Description of Prior Art

Usually, an electronic device such as digital camera and PDA deploys an electrical card for increasing the storage of the device. The electrical card connector is used for connecting the electrical card to the electronic device. The electrical card connector, such as U.S. Pat. No. 6,206,710, always comprises an insulative housing, a shell covering the insulative housing and a plurality of terminals received in the insulative housing. The shell forms a plurality of soldering plates extending outwardly from the opposite sides thereof, respectively, for positioning the connector on a PCB. Obviously, the outwardly extending soldering plates occupy the internal space of the electronic device.

For occupying less internal space to fit the development of miniaturization, a new card connector, whose soldering plates bend inwardly from the opposite sides of the shell, disclosed by U.S. Pat. No. 6,648,694 is appeared. However, the inwardly extending soldering plates bring a new question that we need assemble the shell to housing from a card inserting opening of the housing to the opposite end of the housing in a vertical card inserting direction. Therefore, at the beginning of the assemble, the majority of the shell is beyond the housing. According we needs more vertical space to finish the assemble process.

Hence, it is desirable to have an improved card connector to overcome the above-mentioned disadvantages of the prior art.

BRIEF SUMMARY OF THE INVENTION

Accordingly, the object of the present invention is to provide an electrical card connector occupying less space.

In order to achieve the above-mentioned object, an electrical card connector adapted for receiving an electrical card, comprises an insulative housing, a plurality of terminals received in the insulative housing, and a shell assembled on the insulative housing. The insulative housing comprises a front wall and a pair of lateral walls extending from the opposite ends of the front wall, the insulative housing defines a card inserting opening opposite to the front wall along a card inserting direction. The shell comprises a main portion and a pair of lateral portions extending downwardly from the opposite sides of the main portion, each lateral portion only defines a soldering plate extending inwardly therefrom at the distal end thereof adjacent to the card inserting opening.

Other objects, advantages and novel features of the invention will become more apparent from the following detailed description of the present embodiment when taken in conjunction with the accompanying drawings.

DETAILED DESCRIPTION OF THE INVENTION

Figure 1:
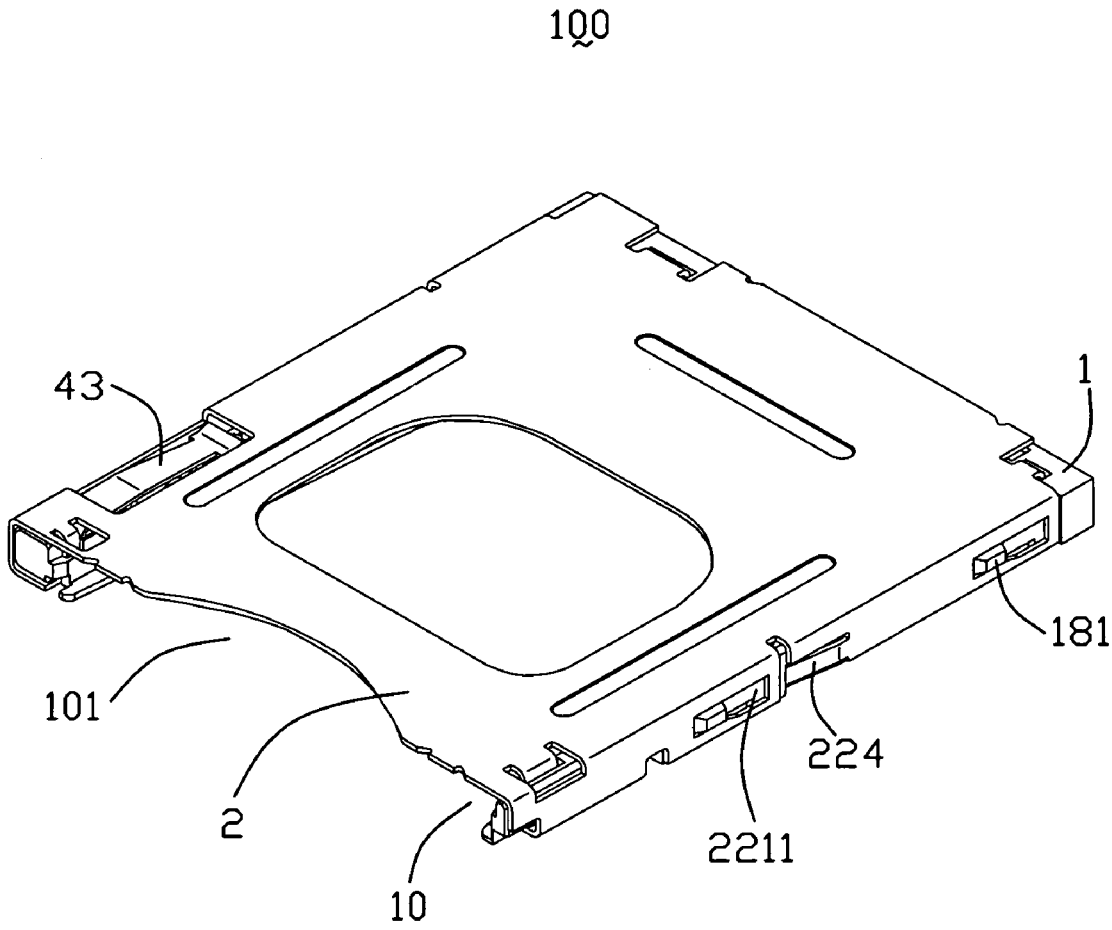
FIG. 1 is a perspective view of an electrical card connector in accordance with the present invention.

Reference will now be made to the drawing figures to describe the present invention in detail.

Figure 2:
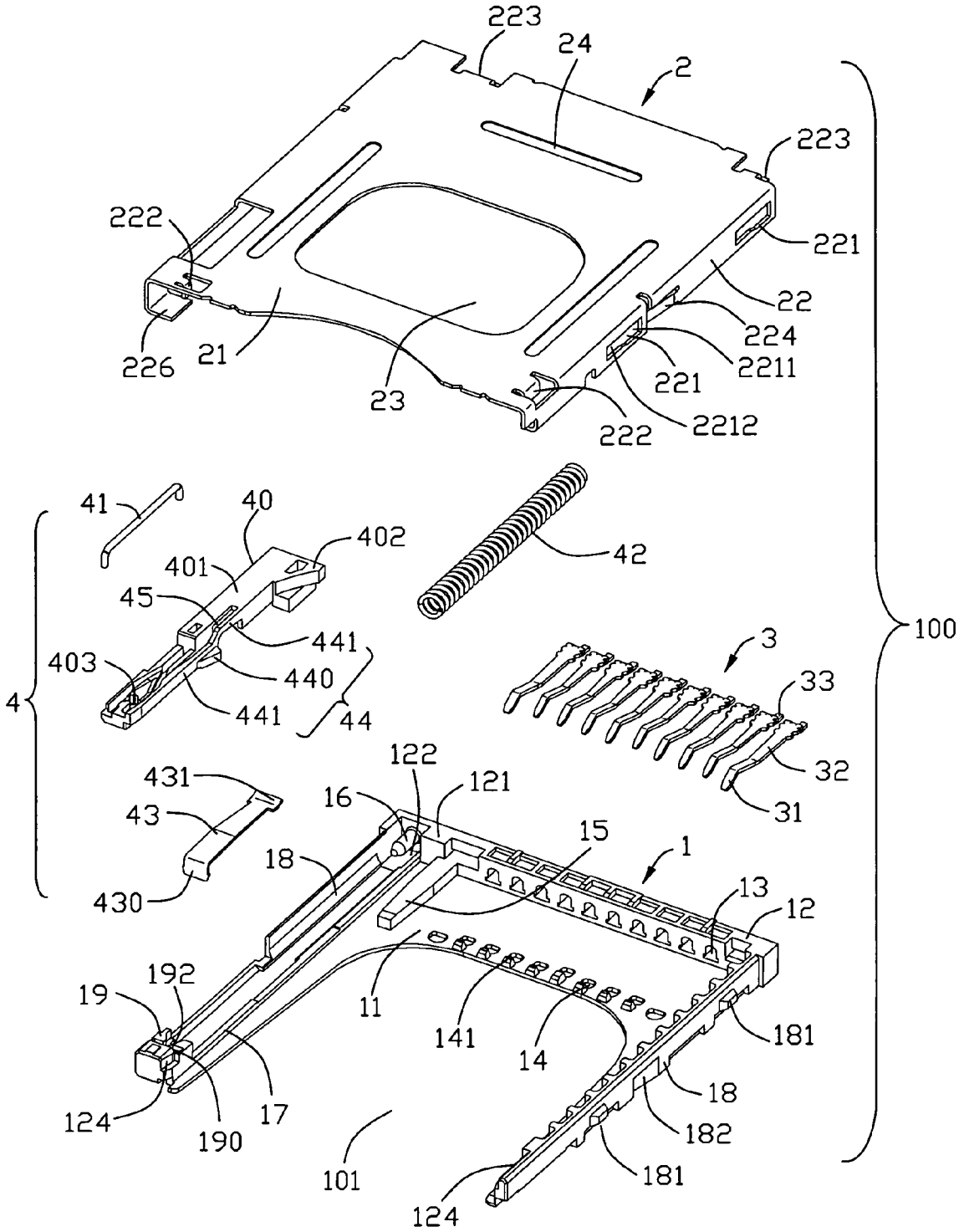
FIG. 2 is an exploded, perspective view of the electrical card connector shown in FIG. 1.

Referring to FIG. 1 and FIG. 2, an electrical connector 100 for receiving an electrical card comprises an insulative housing 1, a plurality of terminals 3 receiving in the insulative housing 1, a shell 2 covering the insulative housing 1, and an ejecting mechanism 4 assembled on one side of the insulative housing 1. The insulative housing 1 and the shell 2 together defines a card inserting opening 101 opposite to the terminals 3 in a card inserting direction and a receiving space 10 between the card inserting opening 101 and the terminals 3.

Particularly referring to FIG. 2, the insulative housing 1 of U-shape comprises a front wall 12, a pair of lateral walls or side portions 18 extending from the opposite ends of the front wall 12 and an U-shape low wall 11 connecting the bottom surface of the front wall 12 and the lateral walls 18. The front wall 12 in turn arranges a plurality of terminal receiving passageways 13, a stopping block 121 and a guide post 16 in a lateral direction. A guide channel 122 is defined between the stopping wall 121 and the left lateral wall 18 and along the left lateral wall 18, the guide post 16 is formed in the guide channel 122. The left lateral wall 18 forms a embossment 19 at the distal end adjacent to the card inserting opening 101. The embossment 19 defines a retaining slot 190, a gap 124 communicating with the receiving space 10 and a hole 192 thereon. Additionally, the low wall 11 arranges a plurality of through-holes 14 thereof corresponding to the terminals 3, and a plurality of blocks 141 corresponding to the through-holes in the card inserting direction. The blocks 141 guide the electrical card into the electrical card connector 100 and prevent the terminals 3 from destroying. The front wall 12 arranges a rib 15 between the terminal receiving passageways 13 extending into the receiving space 10 for mating with the card. The low wall 11 comprises a guide rail 17 extending along the guide channel 122. Each outside surface of the lateral wall 18 forms a plurality of bulges 181 and a holding face 182 depressed inwardly therefrom.

Each terminal 3 comprises a contact portion 31, a retention portion 32 extending forwardly from the contact portion 31 and a solder portion 33 for jointing the terminal 3 to Printed Circuit Board (PCB) (not shown). Each retention portion 32 of the terminal 3 is received in corresponding terminal receiving passageway 13. The contact portion 31, extends into the receiving space 10 behind the blocks 141 and above the through holes 14. When the electrical card is inserted into the receiving space 10, the terminals 3 can bend into corresponding through-holes 14 to prevent the terminal 3 from distortion of pressing it repeatedly.

Figure 3:
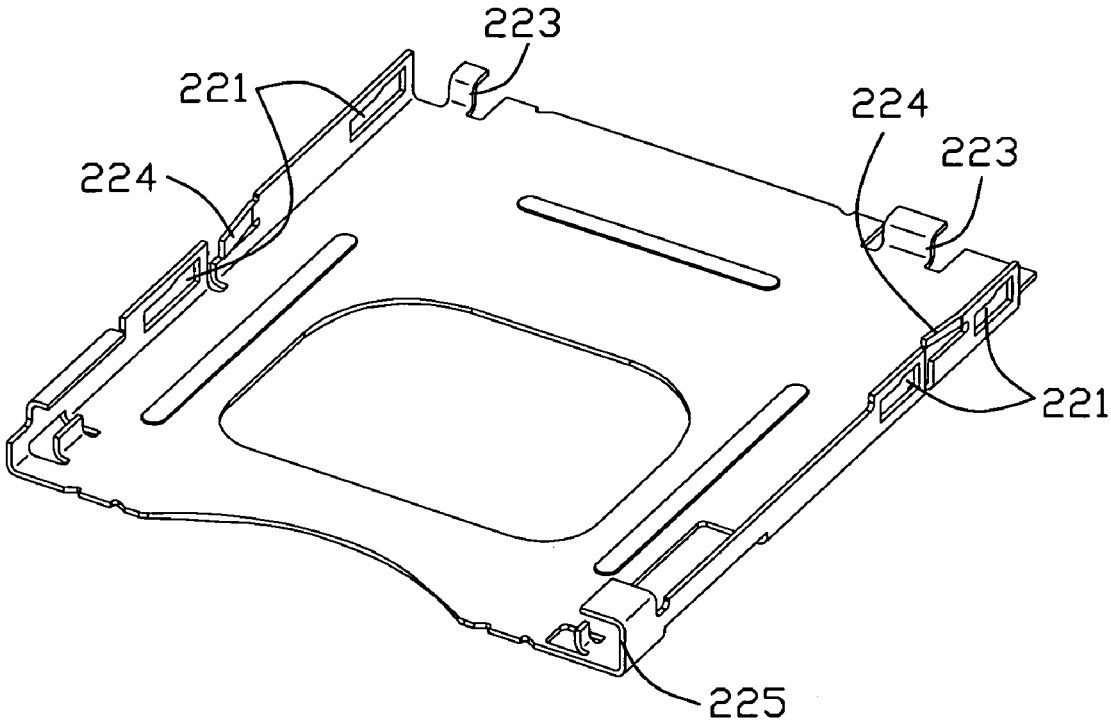
FIG. 3 is an perspective view of a shell shown in FIG. 1.

Joining FIG. 2 and FIG. 3, the shell 2, made of a metal plate, comprises a main portion 21 and a pair of lateral portions or side walls 22 extending downwardly from two lateral sides of the main portion 21. The main portion comprises a square hole 23 at the center thereof, a plurality of caves 24 surrounding the square hole 23, two vertical pieces 222 extending downwardly therefrom adjacent to the card inserting opening 101. Each lateral portion comprises a soldering portion 226 bent inwardly from the end adjacent to the card inserting opening 10 and close to the corresponding vertical piece 222, a spring tab extending inwardly corresponding to the holding face 182 and a plurality of cutouts 221 corresponding to the bulges 181. The cutout 221, longer the bulges 181 in the card inserting direction, comprises a narrow end 2212 and a large end 2211 communicating with the narrow end 2212. The length in an up-to-down direction of the large end 2211 of the cutout 221 is larger than that of the bulge 181, and the length in the up-to-down direction of the narrow end 2211 is approximately equal to that of the bulge 181.

Figure 4:
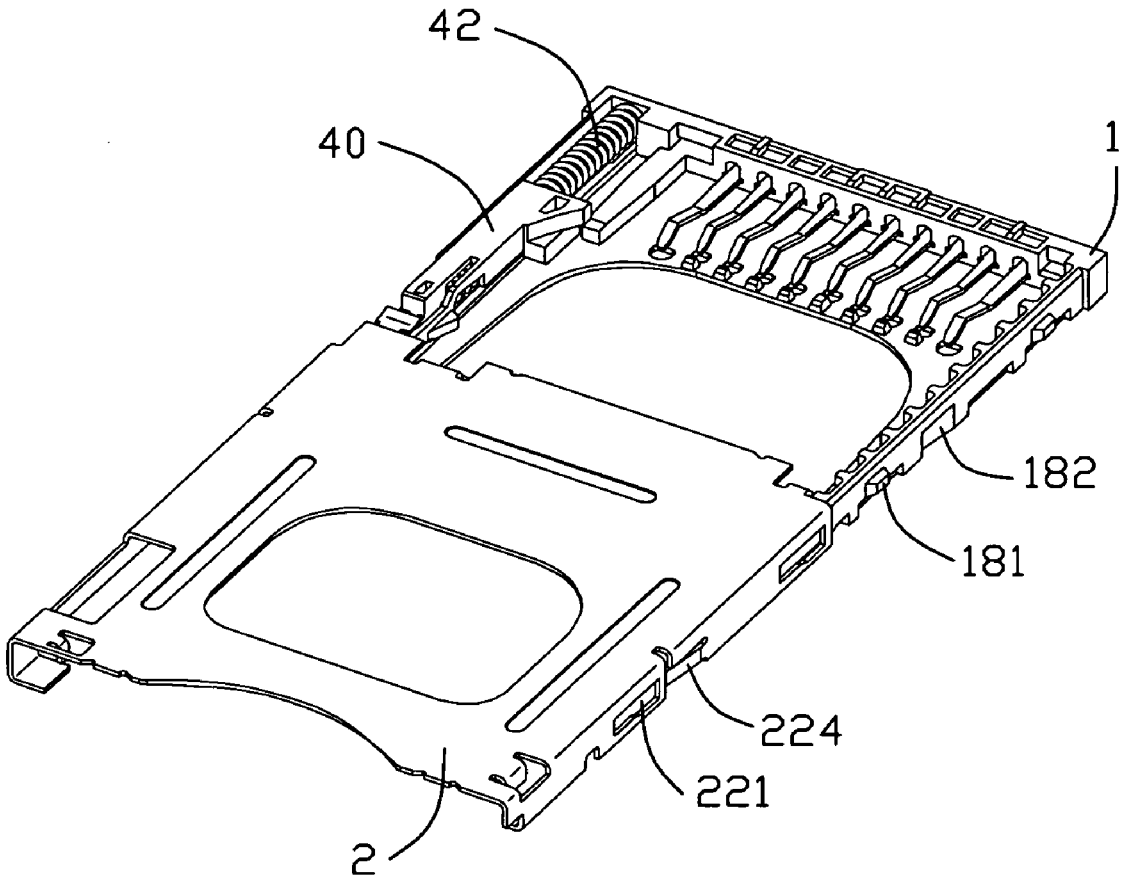
FIG. 4 is a perspective view of the shell partially separated from the housing.

Referring to FIG. 2 to FIG. 4, the ejecting mechanism 4 is disposed on the inner side of the lateral wall 18, and comprises a slider 40, an ejecting arm 402, a cam follower 41, an spring element 42 and an elastic piece 43. The slider 40 is movably received in the guide rail 17 of the insulative housing 1 along the card inserting direction. The slider 40 comprises a base portion 401, a lock device 44 approaching to the receiving space 10 and a rear portion (not labeled) with a heart groove 403 extending from the base portion 401 backwardly. The rear portion is lower than the base portion 401 to reduce the height of the electrical card connector 100. The lock device 44 comprises a lock member 440 connecting to the slider 40 in the front-to-rear direction by two flexible arms 441, and said two flexible arms 441 assume step-shaped distribution. The front flexible arm 441 connecting to the base portion 401 defines an inner space 442 at the bottom thereof. A slot 45 with a certain width is defined between the flexible arms 441 and the slider 40. The lock member 440 inserts into the gap 501 of the electrical card 50 for holding the electrical card on the slider 40. The cam follower 41 is made through a metal bar with, two ends thereof bending downwardly. One end of the cam follower 41 is held by the hole 192 of the embossment 19 (not shown), and the other end of the cam follower 41 moves along the heart groove 403. The spring element 42 is arranged between the slider 40 and the front wall 12 of the insulative housing 1. One end of the spring element 42 is disposed on the guide post 16, and the other end is disposed on the slider 40. The spring element 42 partially extends into the inner space 442 of the flexible arm 441. In present invention, the spring element 42 is a spring. The elastic piece 43 comprises a holding member 430 and a cantilever 431 extending from the holding member 430 forwardly. The holding member 430 inserts into and is retained in the retaining slot 190 of the insulative housing 1 (not shown). The cantilever 431 presses on the top surface of the cam follower 41 to keep the cam follower 41 retaining in the heart groove 403.

During assembly, firstly, the shell 2 is placed to the housing along the up-to-down direction perpendicular to the card inserting directing till the bulges 181 are received in the larger ends of corresponding cutouts 221 and the soldering plates 226 attach the card inserting opening in the card inserting direction. And then, move the shell along the card inserting direction to let the bulges 181 be received in the narrow end of corresponding cutouts, the spring tabs 224 engage corresponding holding faces 182 and one of the vertical pieces 222 into the gap 124. Thereby, a huge space is saved at the beginning of assembling the shell onto the housing. It can be understood that a lateral wall 18 of the housing is circumferentially wrapped by the solder plate 226, the lateral portion 22, the main portion 21 and the vertical piece 222 for restraining both vertical and lateral movements.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector adapted for receiving an electrical card, comprising:

an insulative housing comprising a front wall and a pair of lateral walls extending from the opposite ends of the front wall, the insulative housing defining a card inserting opening opposite to the front wall along a card inserting direction;

a plurality of terminals received in the insulative housing; and a shell assembled on the insulative housing and comprising a main portion and a pair of lateral portions extending downwardly from the opposite sides of the main portion, each lateral portion defining a single soldering plate extending inwardly therefrom at the distal end thereof adjacent to the card inserting opening;

wherein at least one of the single soldering plates cooperates with the corresponding lateral portion and the main portion to form a rectangular receiving section adjacent to the card inserting opening;

wherein the shell is initially assembled to the insulative housing in a first direction perpendicular to the card inserting direction to lock with the insulative housing temporarily, then, the shell slides on the insulative housing in a second direction along the card inserting direction to lock with the insulative housing.

2. The electrical card connector as claimed in claim 1, wherein each lateral wall of the insulative housing forms a holding face depressed inwardly therefrom, and wherein each lateral portion of the shell forms a spring tab bent inwardly therefrom engaging with the holding face of the insulative housing.

3. The electrical card connector as claimed in claim 1, wherein the main portion of the shell forms a downwardly extending vertical piece adjacent to the card inserting opening, and wherein one of the lateral walls of the housing defines an embossment with a gap at the distal end thereon said vertical piece being resisted in the gap.

4. The electrical card connector as claimed in claim 1, wherein the insulative housing comprises a lower wall connecting the lateral walls and the front wall.

5. The electrical card connector as claimed in claim 1, further comprising an ejecting mechanism mounted on the insulative housing.

6. The electrical card connector as claimed in claim 1, wherein at least one of the distal end of the lateral walls of the insulative housing is inserted into the rectangular receiving section of the shell, after the shell sliding on the insulative housing.

7. The electrical card connector as claimed in claim 1, wherein each lateral wall of the insulative housing forms a bulge thereon, and each lateral portion of the shell defines a cutout thereon, said bulges movably received in the cutout.

8. The electrical card connector as claimed in claim 7, wherein a length of said cutout in both the card inserting direction and an up-to-down direction, measured perpendicular to the card inserting direction, is not less than that of the bulge.

9. The electrical card connector as claimed in claim 8, wherein the cutout has a narrow end and a large end communicating with the narrow end, the length of the large end in the up-to-down direction is larger than that of the bulge, and the length of the narrow end in the up-to-down direction is approximately equal to the bulge.

10. An electrical card connector comprising:

an insulative housing;

a plurality of terminals disposed in the housing; and a metallic shielding covering said housing and cooperating with the housing to define a card receiving cavity; wherein said shield includes a horizontal main portion covering said card receiving cavity and two downward side walls, at least one of said side wall includes unitarily a horizontal solder pad extending inward toward the card receiving cavity around a front edge of the shield;

wherein said horizontal solder pad cooperates with the corresponding side wall and the main portion to form a rectangular receiving section adjacent to the card inserting opening;

wherein the metallic shielding is initially assembled to the housing in a first direction perpendicular to a card inserting direction to lock with the housing temporarily, then, the metallic shielding slides on the housing in a second direction along the card inserting direction to lock with the housing.

11. The electrical card connector as claimed in claim 10, wherein said rectangular receiving section wraps side portion of the housing, after the metallic shielding sliding on the housing.

12. The electrical card connector as claimed in claim 10, wherein the side portion of the housing rather than the side wall of the shielding laterally restrains insertion of an electronic card.

13. The electrical card connector as claimed in claim 10, wherein said shield further forms a vertical piece close to said solder pad.

14. The electrical card connector as claimed in claim 13, wherein said side portion of the housing forms a gap into which said vertical piece extends.

15. An electrical card connector comprising:

an insulative housing;

a plurality of terminals disposed in the housing; and a metallic shield covering said housing and cooperating with the housing to define a card receiving cavity; wherein said shield includes a horizontal main portion covering said receiving cavity and two downward side walls, at least one of said side wall includes unitarily a horizontal solder pad extending inward toward the card receiving cavity, a vertical piece extending from the horizontal main portion close to said horizontal solder pad; wherein said horizontal solder pad cooperates with said vertical piece, the corresponding side wall and the main portion to wrap a side portion of the housing for circumferentially restraining both vertical and lateral movements of said side portion of the housing relative to the shield.

16. The electrical card connector as claimed in claim 15, wherein the metallic shielding is initially assembled to the housing in a first direction perpendicular to a card inserting direction to lock with the housing temporarily, then, the metallic shielding slides on the housing in a second direction along the card inserting direction to lock with the housing.

17. The electrical card connector as claimed in claim 15, wherein the side portion of the housing rather than the side wall of the shielding laterally restrains insertion of an electronic card.

18. The electrical card connector as claimed in claim 11, wherein said solder pad is located adjacent to a card inserting opening through which an electronic card is inserted into the card receiving cavity.

19. The electrical card connector as claimed in claim 15, wherein said side portion of the housing forms a gap into which said vertical pieces extends.

* * * * *